US007347016B2

(12) United States Patent
Dane

(10) Patent No.: US 7,347,016 B2
(45) Date of Patent: Mar. 25, 2008

(54) APPARATUS PROVIDING AT LEAST A VISUAL IMPRESSION OF FLUID MOVING IN A CHANNEL AND METHOD OF ATTACHING AN APPARATUS PROVIDING SAID VISUAL IMPRESSION

(76) Inventor: Brian Dane, 35891 Argonne St., Newark, CA (US) 94560

( * ) Notice: Subject to any disclaimer, the term of this patent is extended or adjusted under 35 U.S.C. 154(b) by 0 days.

(21) Appl. No.: 10/355,818

(22) Filed: Jan. 30, 2003

(65) Prior Publication Data

US 2004/0148828 A1 Aug. 5, 2004

(51) Int. Cl.
*G09F 19/00* (2006.01)

(52) U.S. Cl. ..... 40/430; 40/406

(58) Field of Classification Search ..... 40/329, 40/430, 431, 406, 432; D20/37; 239/211, 239/17; 446/283
See application file for complete search history.

(56) References Cited

U.S. PATENT DOCUMENTS

| | | | | | |
|---|---|---|---|---|---|
| 462,510 | A | * | 11/1891 | Roemer et al. | 40/431 |
| 1,903,537 | A | * | 4/1933 | Sutliffe | 40/432 |
| 3,964,189 | A | * | 6/1976 | Belokin, Jr. | 40/414 |
| 4,586,280 | A | * | 5/1986 | Dane | 40/329 |
| 4,631,210 | A | | 12/1986 | McGee et al. | |
| 5,088,127 | A | | 2/1992 | Thornock | |
| 5,109,620 | A | | 5/1992 | Torrence | |
| 5,247,754 | A | * | 9/1993 | Belokin, Jr. | 40/414 |
| 5,266,920 | A | | 11/1993 | Langner | |
| 5,462,471 | A | | 10/1995 | Power-Fardy | |
| 5,547,718 | A | | 8/1996 | Shapiro | |
| D377,738 | S | | 2/1997 | Thorne | |
| 5,678,918 | A | * | 10/1997 | Lin | 362/96 |
| 5,740,557 | A | | 4/1998 | Reid et al. | |
| 6,007,211 | A | | 12/1999 | Cheung | |
| 6,049,914 | A | | 4/2000 | Heilman | |
| 6,062,380 | A | | 5/2000 | Dorney | |
| 6,153,273 | A | * | 11/2000 | Lee Lin | 428/13 |
| 6,282,820 | B1 | | 9/2001 | White et al. | |
| 6,419,111 | B1 | | 7/2002 | Kepner | |
| 6,447,137 | B1 | | 9/2002 | Long | |
| 6,467,206 | B1 | | 10/2002 | Bognar | |

* cited by examiner

*Primary Examiner*—Joanne Silbermann
(74) *Attorney, Agent, or Firm*—Earle Jennings; GSS Laaw Group

(57) ABSTRACT

An apparatus is disclosed providing a visual impression of fluid flowing in a channel solving at least the problems associated with prior art apparatus providing such visual impressions while using a fluid. A method is disclosed attaching an apparatus providing a visual impression of a fluid flowing through a channel into a housing, and including at least one attaching mechanism non-invasively attaching the apparatus to a provided mounting surface.

25 Claims, 7 Drawing Sheets

APPARATUS PROVIDING AT LEAST A VISUAL IMPRESSION OF FLUID MOVING IN A CHANNEL AND METHOD OF ATTACHING AN APPARATUS PROVIDING SAID VISUAL IMPRESSION

TECHNICAL FIELD

This invention relates to providing the visual impression of fluid flowing in a channel for the purposes of amusement and advertising.

BACKGROUND ART

Many people are fond of seeing the flow of fluid in a channel, particularly when the fluid resembles a favorite beverage. This association of fondness has been used to create many mechanisms providing amusement, entertainment, as well as providing an avenue for presenting advertising messages.

While these devices succeed in creating a visual impression of fluid flow, the inventor has discovered several problems associated with the prior art mechanisms limiting their usefulness. The inventor's prior invention disclosed in U.S. Pat. No. 4,586,280 (referred to as '280 hereafter) provided a similar impression. It used a water reservoir, electric pump and a nine volt battery, all installed on a cap, which must either be specially manufactured, or have holes punched in it.

There were several problems with the approach of the '280 patent and other approaches to providing the visual impression of fluid flowing in a channel. These problems will be discussed in terms of the '280 to streamline the discussion.

A water reservoir can not store water indefinitely. Over time, the water evaporates. This limits shelf life. If the water chamber is refillable, this leads to additional problems by allowing individuals to refill the reservoir with a substance other than water, such as alcohol or soda. Such substances might well cause the individuals harm and/or damage the unit. Note that over filling reservoir may also cause damage to the mechanism, irrespective of what fluid is used.

Another problem associated with storing water in the '280 patent has to do with hot circumstances, such as a sporting event on a bright summer day. The unit may be exposed to intense sunlight for a prolonged period of time. The absorbed heat can cause the water in the unit, which is sealed, to rise to the top, creating a vapor lock. The only way for the pressure to release is for the water to enter the motor compartment, causing the motor to rust and stall.

There are other problems with the invention of the '280 patent. There was no way to quickly install a unit onto a cap, limiting its use in retail situations to pre-installed units. It required the cap be punctured in several places, with a battery pack mounted on one side, a tap, water chamber and motor/pump installed on a front, vertical surface (during normal operation). The battery pack then had to be wired to the pump through the cap. The pump in turn had a feed from the base installed through the holes in the cap.

In the '280 patent, a nine volt battery mounts on the cap, which is uncomfortable for the wearer. The battery is also potentially dangerous to the wearer, due to the possibility of battery discharge.

What is needed is a mechanism and/or way to provide the visual impression of fluid flowing in a chamber, without the problems associated with storing and using a fluid. What is further needed is a way to attach such a mechanism non-invasively to a mounting surface. The mounting surface should include at least some of the following: a beret, a cap, a hat, a shirt, a wall, a refrigerator, an automotive surface, a cash register, and a computer terminal.

SUMMARY OF THE INVENTION

The invention addresses at least the problems discussed in the background.

The invention includes an apparatus providing a visual impression of fluid flowing in a channel. The channel is hollow 10 with a first end 12 and a second end 14. A hollow helical shaft 20 is positioned between first end 12 and second end 14 within hollow channel 10. An electric motor 40 is coupled 30 with hollow helical shaft 20 near second end 14 to rotate hollow helical shaft 20 within hollow channel 10. An electrical power supply 50 powers electric motor 40 in rotating hollow helical shaft 20 to create visual impression. Note that the hollow helical shaft 20 seen within hollow channel 10 has a color similar to the fluid.

The invention removes the problems associated with the use and storage of fluids in the prior art, extending the shelf life of embodiments, improving their safety, making them more reliable products.

The hollow helical shaft preferably rotates within the hollow channel between 120 and 240 Revolutions Per Minute (RPM). The hollow helical shaft may further be preferred to rotate between 172 and 200 RPM.

Note that the hollow channel 10 preferably approximates a circular cylinder. However, the hollow channel 10 may alternatively approximate other hollow shapes, including, by way of example, an elliptical cylinder and a rectangular chamber. Hollow channel 10 may be wider than it is tall in certain embodiments, and this relationship may vary among embodiments. The exterior of hollow channel 10 may preferably be a different shape than its interior.

The invention may further include more than one hollow helical shaft 20 within hollow channel 10. Not all of the multiple helical shafts need rotate at the same time.

The invention preferably further includes at least, one and preferably both, a housing 70 containing an electric power supply 50 and at least electric motor 40, as well as a top piece 100 near first end 12. Housing 70 and top piece 100 collectively couple to at least one means for attaching 80 the unit to a mounting surface 4. The visual impression of fluid flowing in hollow channel 10 may further include the fluid flowing toward first end 12 and/or the fluid flowing toward second end 14.

The invention may further include a means for making sounds at least whenever hollow helical shaft 20 is rotating.

The invention further, preferably, includes logo zone 110, which provides a method of displaying entertaining and advertising messages.

The invention further, preferably, includes at least a switch 60 controlling at least electric motor 40 rotating hollow helical shaft 20 to create the visual impression of fluid flowing in hollow channel 10. Switch 60 may be located either within housing 70, which is preferred, or outside housing 70, possibly in, on, or near top piece 100.

The invention further, preferably, includes at least one light source 90, active at least whenever hollow helical shaft 20 is rotating. It is often preferred that there be two light sources. The light source(s) may further, preferably, provide additional visual impressions: of the fluid in the housing 70, the fluid entering the housing 70, and possibly the fluid entering the top piece 100.

The invention includes a preferred method attaching an apparatus providing a visual impression of a fluid flowing through a channel 10 into a housing 70, and including at least attaching mechanism 80. A mounting surface 4 of said display mount is provided. The apparatus is non-invasively attached to mounting surface 4 using attaching mechanism 80.

This method of non-invasively attaching the apparatus supports rapid installation of the apparatus on at least any of a beret, a cap, a hat, a shirt, a portion of a wall, a refrigerator, an automotive surface, a cash register surface, and a computer terminal. Note that in certain embodiments, the wall may be the wall of an advertising billboard and the apparatus being attached may range in height from a few centimeters to many meters.

When the attaching mechanism is a hook and loop fastener such as VELCRO (a trademark of Velcro Industries B.V. PRIVATE LIMITED LIABILITY COMPANY NETHERLANDS Castorweg 22-24 Curacao NETHERLANDS ANTILLES), or a magnet, it is also easy to remove the apparatus for purposes such as cleaning.

The invention includes methods for making the hollow helical shaft 20, which may include extrusion molding, machining, as well as bonding of components, to create hollow helical shaft 20. Hollow helical shaft 20 may be either solid, or hollow, which would favor the bonding of two halves manufacturing approach. The invention includes the hollow helical shaft 20 as a product of the processing making the shaft, as well as assemblies providing a visual impression of fluids flowing based upon rotating the hollow helical shaft in the assemblies.

The invention includes methods of assembly of the various embodiments of the invention, which will be discussed regarding FIGS. 5A and 5B, as well as those embodiments as product of the processing assembling them.

The invention also includes the method providing the visual impression of fluid flowing in a channel. An electric power supply 50 provides an electric motor 40 with power. The electric motor 40 through a coupling 30 rotates a hollow helical shaft 20 within the channel 10. The invention further includes the means for implementing this method.

The invention also includes apparatus and methods controlling the providing of the visual impression of fluid flowing in a channel 10. A user control 62 coupled through at least a shaft 20 within channel 10, controls the state of switch 60, which further controls the operation of electric motor 40. This aspect of the invention removes the need for wiring from a user control 62 located outside housing 70.

These and other advantages of the present invention will become apparent upon reading the following detailed descriptions and studying the various figures of the drawings.

DETAILED DESCRIPTION OF THE INVENTION

Figure 1:
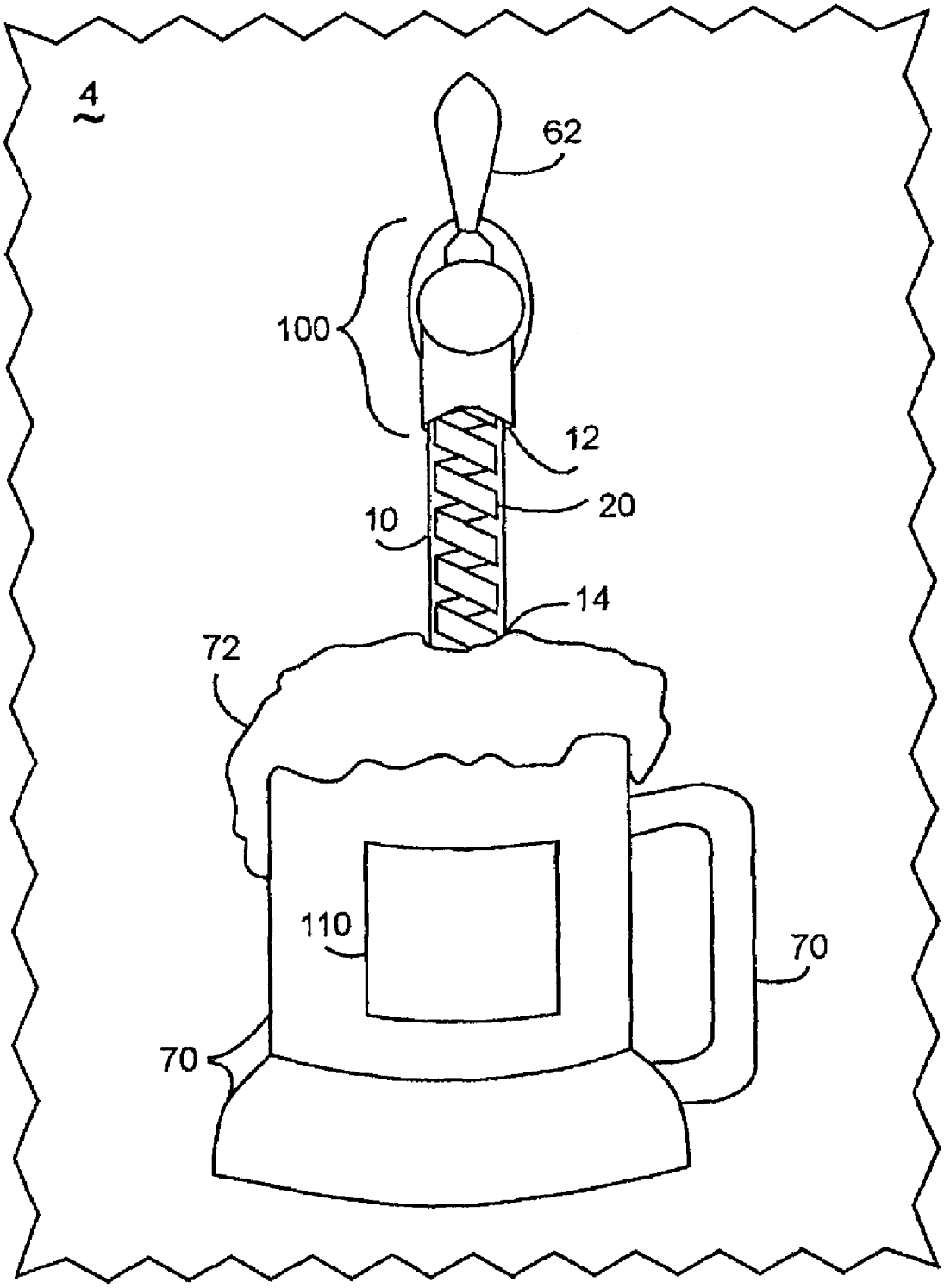
FIG. 1 illustrates an external front view of a preferred embodiment of the invention including user control 62, top piece 100, hollow channel 10, hollow helical shaft 20, top cap 72, housing 70, logo area 78, collectively attached to a mounting surface 4.

FIG. 1 illustrates an external front view of a preferred embodiment of the invention including user control 62, top piece 100, hollow channel 10, hollow helical shaft 20, top cap 72, housing 70, logo area 78, collectively attached to a mounting surface 4.

Figure 2A:
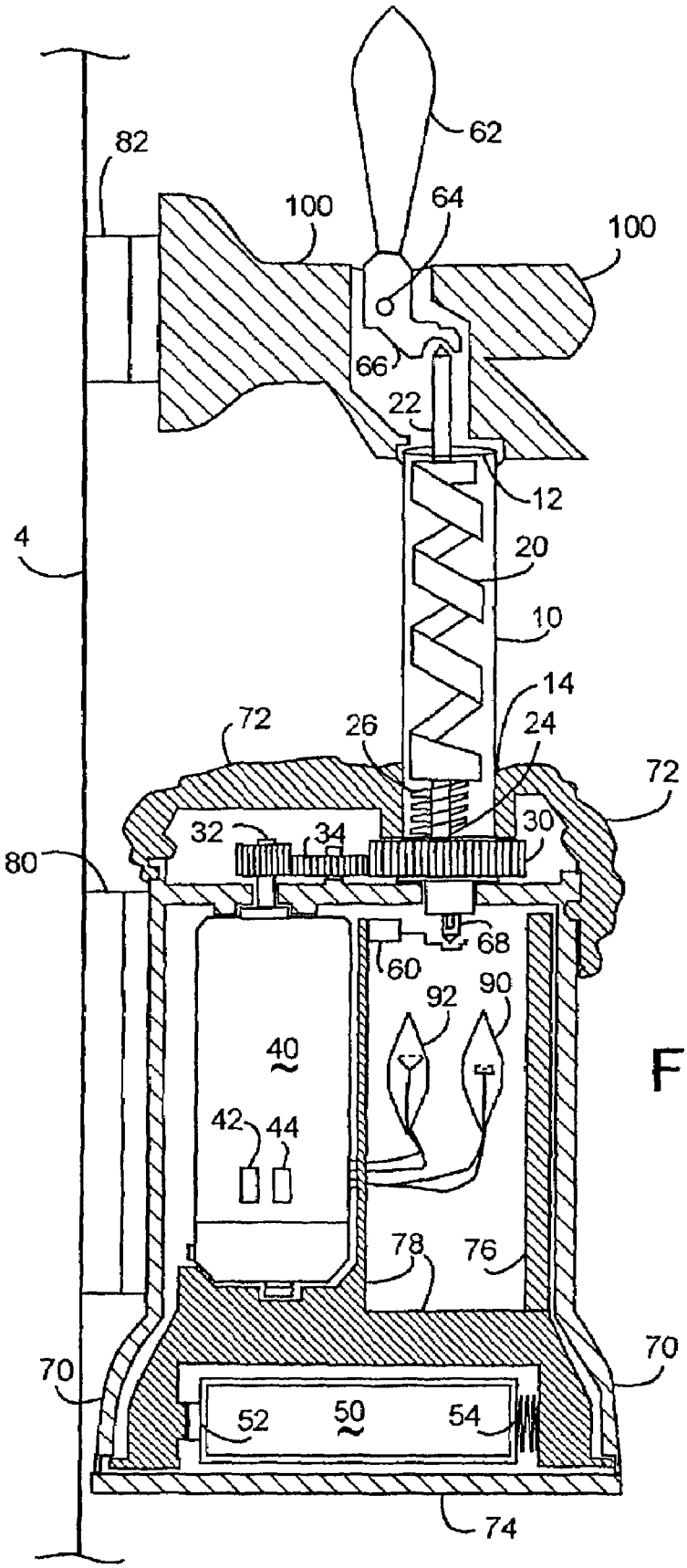
FIG. 2A illustrates a cross section view of the embodiment of FIG. 1, with user control 62 in a first state, and further including electrical power supply 50, electric motor 40 coupling with hollow helical shaft 20 to rotate hollow helical shaft 20 in hollow channel 10 to a visual impression of fluid flowing in hollow channel 10.

FIG. 2A illustrates a cross section view of the embodiment of FIG. 1, with user control 62 in a first state, and further including electrical power supply 50, electric motor 40 coupling with hollow helical shaft 20 to rotate hollow helical shaft 20 in hollow channel 10 to a visual impression of fluid flowing in hollow channel 10.

Figure 2B:
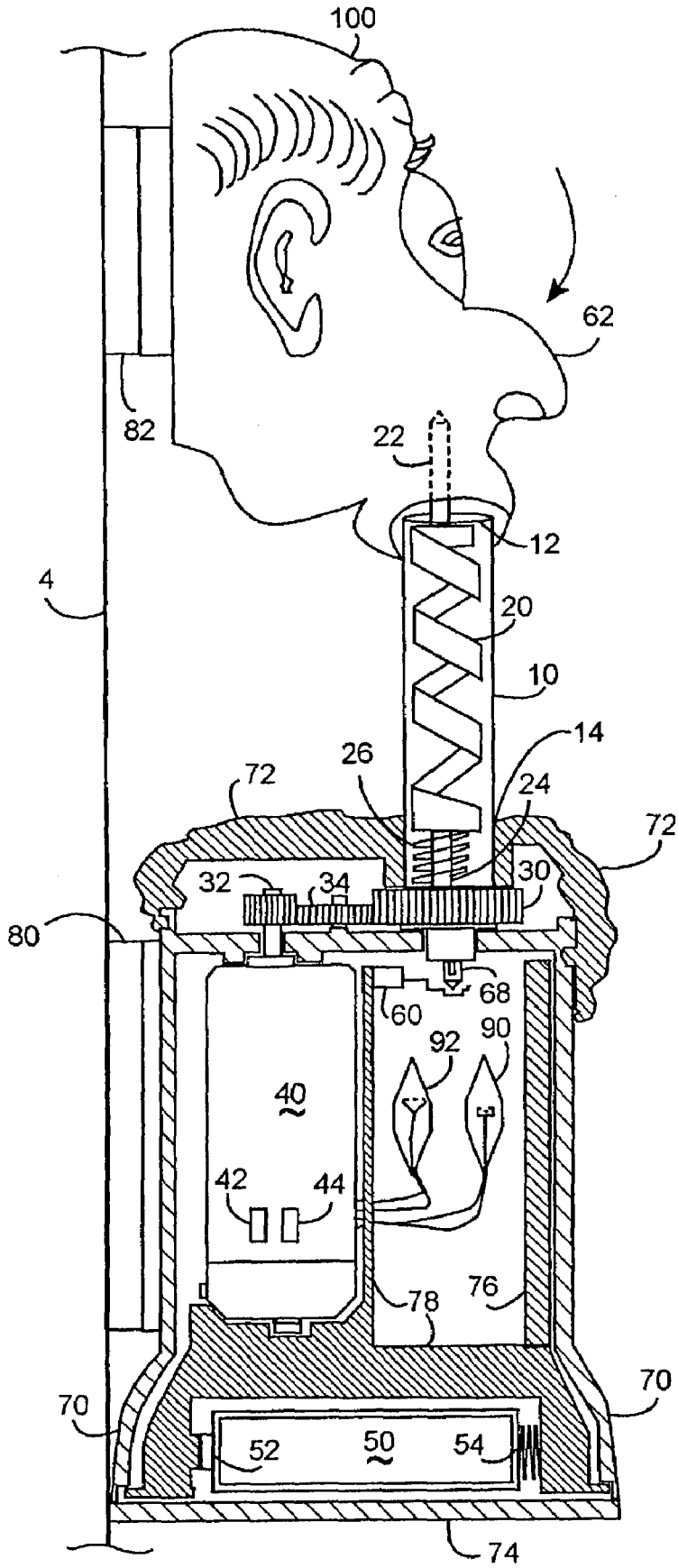
FIG. 2B illustrates a cross section view of an alternative preferred embodiment of FIGS. 1 and 2A, with user control 62 in the first state and with an alternative top piece 100.

FIG. 2B illustrates a cross section view of an alternative preferred embodiment of FIGS. 1 and 2A, with user control 62 in the first state and with an alternative top piece 100.

Figure 2C:
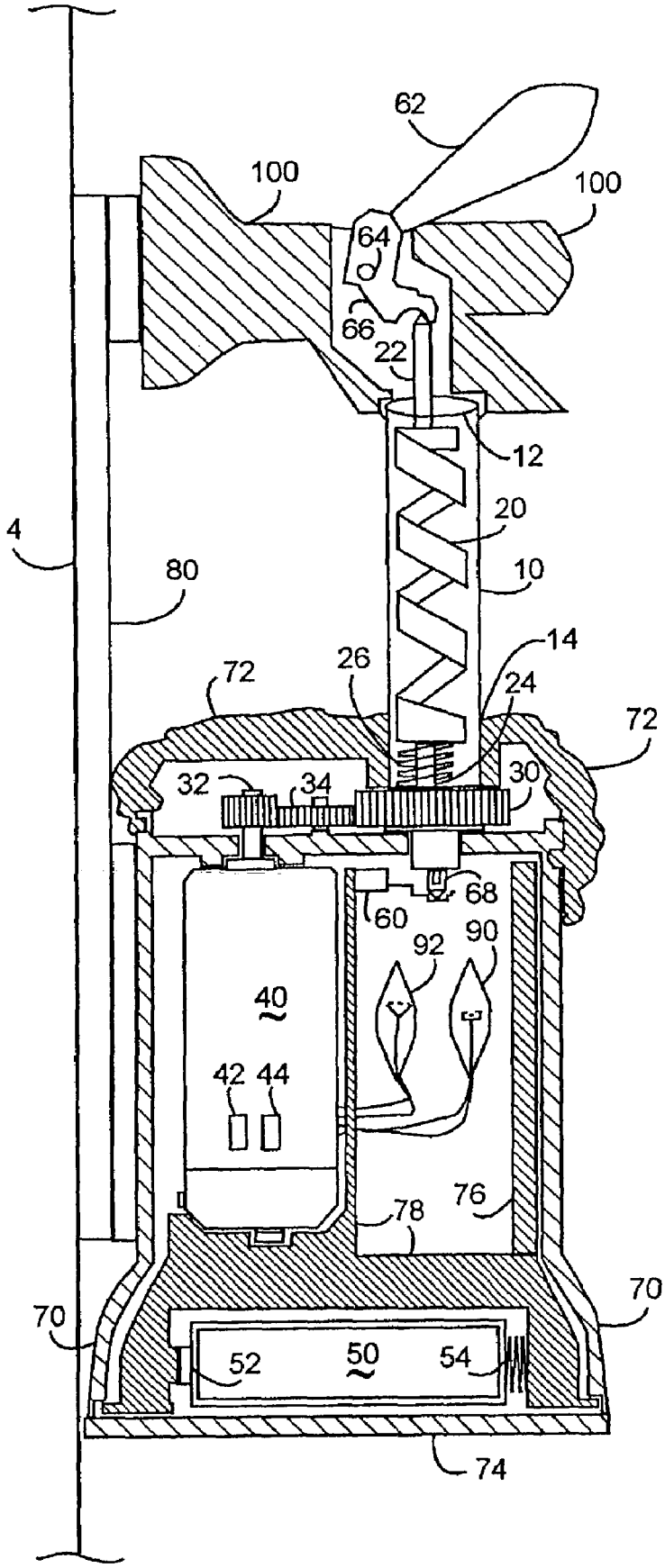
FIG. 2C illustrates the cross section view of FIG. 2A with the user control 62 in a second state, causing switch 60 to be in an on-state.

FIG. 2C illustrates the cross section view of FIG. 2A with the user control 62 in a second state, causing switch 60 to be in an on-state.

In FIGS. 1 to 2C, the illustrated mechanism creates a visual impression of a fluid flowing in hollow channel 10 possessing a first end 12 and a second end 14. Hollow helical shaft 20 is positioned between said first end 12 and said second end 14 within said hollow channel 10.

In FIGS. 2A to 2C, electric motor 40 couples with said hollow helical shaft 20 near said second end 14 to rotate said hollow helical shaft 20 within said hollow channel 10. Electric motor 40 couples with hollow helical shaft 20 through a transmission including gear 30 stepping down to gear 34, further stepping down to gear 32, which couples with drive shaft 24.

Alternatively, electric motor 40 coupling with said hollow helical shaft 20 may include a transmission of any of the following forms: a belt drive transmission, a gear driven transmission, a multi-belt drive transmission, a multi-gear driven transmission, and a combination belt-gear driven transmission.

As used herein, the electric motor rotates at N_MOTOR Revolutions Per Minute (RPM) and couples with a transmission. The transmission couples with the hollow helical shaft to power rotating the hollow helical shaft at N_MOTOR/TRANSMISSION_RATIO to create the visual impression.

The ratio N_MOTOR/TRANSMISSION_RATIO is preferably between 120 RPM and 240 RPM. The ratio N_MOTOR/TRANSMISSION_RATIO is further preferred to be between 172 RPM and 200 RPM.

In FIGS. 2A to 2C, electrical power supply 50 is electrically coupled with electric motor 40 to power electric motor 40 in rotating hollow helical shaft 20 to create said visual impression of fluid flowing in hollow shaft 10.

It should be noted that hollow helical shaft 20 seen within hollow channel 10 has a color similar to said fluid, which cannot be illustrated in a line drawing.

In FIGS. 2A to 2C, electrical power supply 50, electrically coupling with electric motor 40, further includes a switch 60, controlling electric motor 40 in rotating hollow helical shaft 20 to create said visual impression. Switch 60 operates in one of at least an on-state and an off-state. Whenever switch 60 operates in said on-state, electric motor 40 rotates hollow helical shaft 20 to create said visual impression of fluid flowing in hollow channel 10. Whenever switch 60 operates in said off-state, electric motor 40 is prevented from rotating hollow helical shaft 20.

FIGS. 2A to 2C further illustrate a coupling assembly 22-20-24-30 including hollow helical shaft 20 between a user control 62 located near said channel first end 12 and switch 60 located near said channel second end 14. The user control 62 operates in at least one of a first control state and a second control state.

FIGS. 2A and 2B illustrate user control 62 operating in the first control state. Whenever user control 62 operates in said first state, hollow helical shaft coupling 22-20-24-30 puts switch 60 into said off-state. Whenever switch 60 operates in said off-state, electric motor 40 is prevented from rotating hollow helical shaft 20.

FIG. 2C further illustrates user control 62 operating in the second control state. Whenever said user control 62 operates in said second state, said hollow helical shaft coupling 22-20-24-30 puts switch 60 into said on-state. Whenever switch 60 operates in said on-state, electric motor 40 rotates hollow helical shaft 20 to create said visual impression of fluid flowing in hollow channel 10.

In FIGS. 1 to 2C, user control 62 is illustrated as various forms of a lever switch.

Figure 3A:
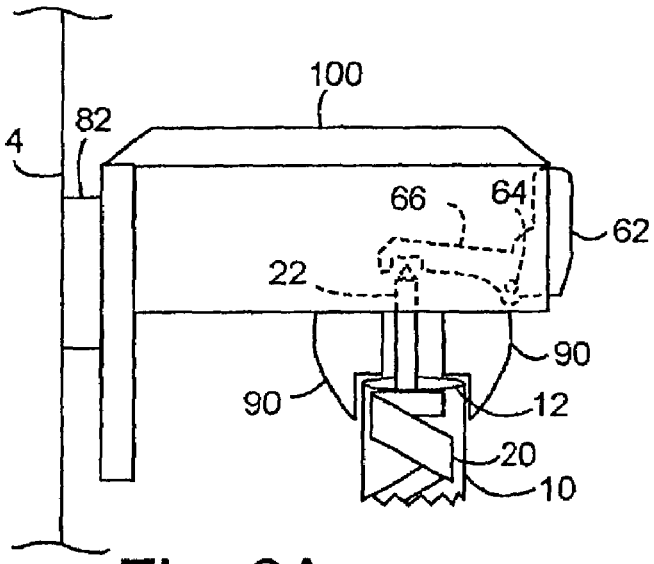
FIG. 3A illustrates a side view of a top piece 100 with a user control 62 as a form of push button.

FIG. 3A illustrates a side view of a top piece 100 with a user control 62 as a form of push button.

Figure 3B:
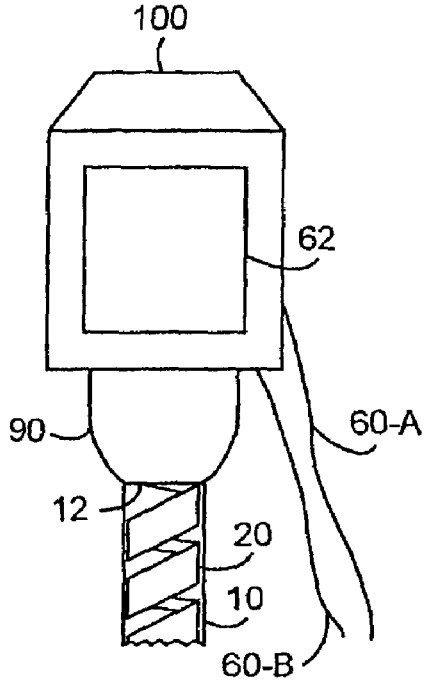
FIG. 3B illustrates a front view of top piece 100 with a user control 62 as a form of push button as in FIG. 3A, as well as alternatively including the terminals 60-A and 60-B of switch 60.

FIG. 3B illustrates a front view of top piece 100 with a user control 62 as a form of push button as in FIG. 3A, as well as alternatively including terminals 60-A and 60-B of switch 60.

Figure 3C:
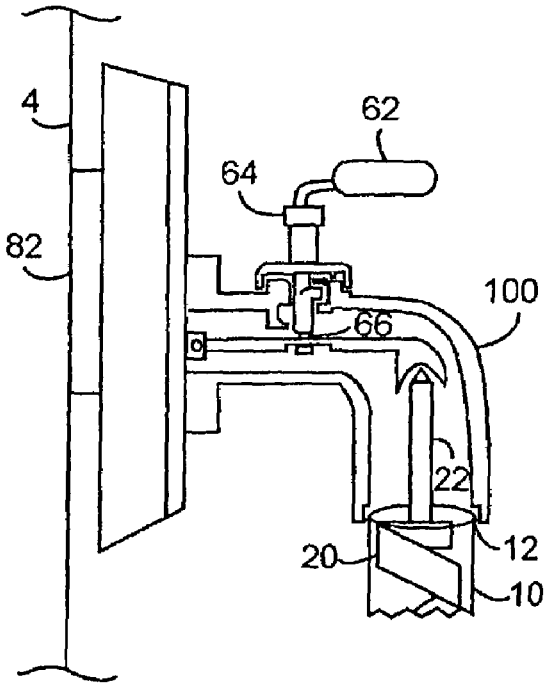
FIG. 3C illustrates a side cross section view of top piece 100 with user control 62 as an alternative lever switch.

FIG. 3C illustrates a side cross section view of top piece 100 with user control 62 as an alternative lever switch.

Figure 3D:
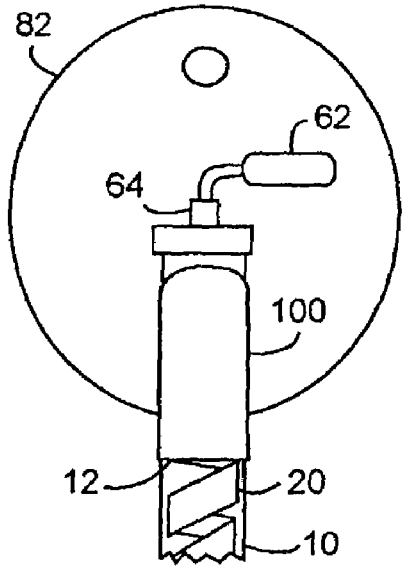
FIG. 3D illustrates a front view of top piece 100 of FIG. 3C.

FIG. 3D illustrates a front view of top piece 100 of FIG. 3C.

Figure 4A:
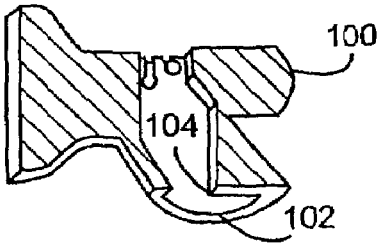
FIG. 4A illustrates a cross section view 100-A from FIG. 5A, of top piece 100 with notch 104 in rim 102, which mates with the notch in hollow channel first end 12 of FIG. 5A.
Figure 5A:
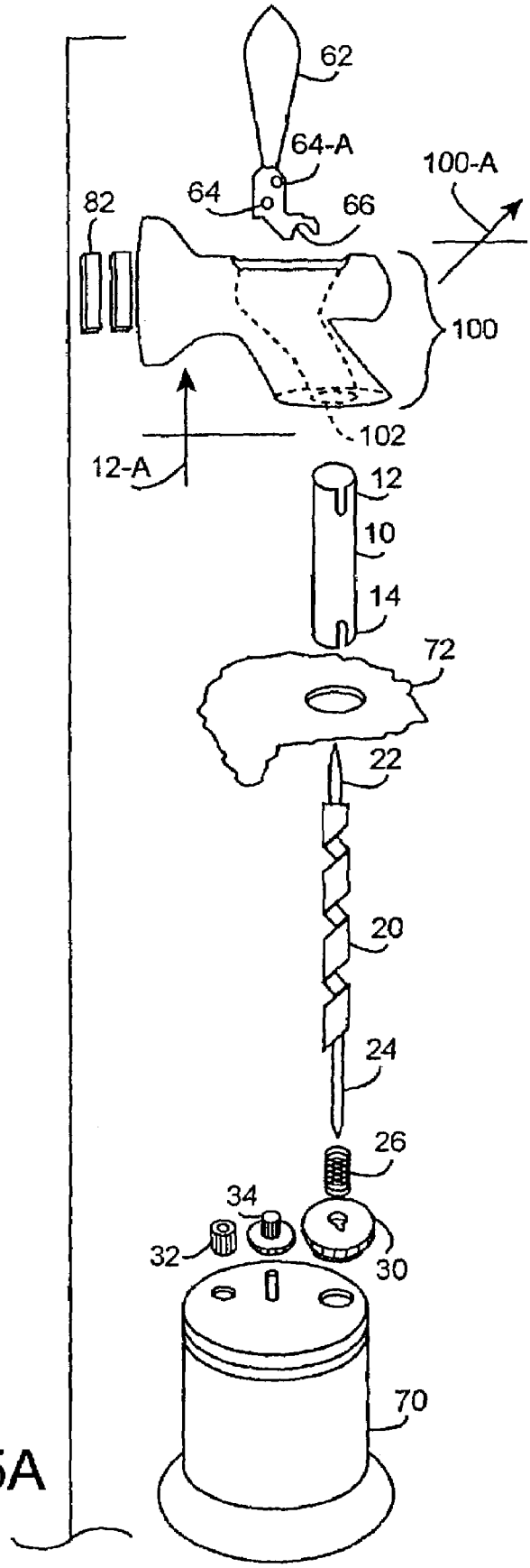
FIG. 5A illustrates an exploded view of the top half of the preferred assembly of the invention.

FIG. 4A illustrates a cross section view 100-A from FIG. 5A, of top piece 100 with notch 104 in rim 102, which mates with the notch in hollow channel first end 12 of FIG. 5A.

Figure 4B:
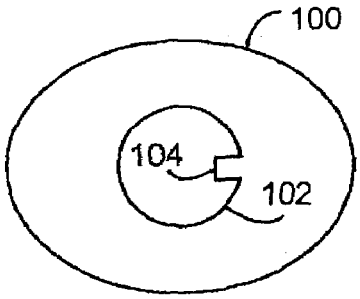
FIG. 4B illustrates a bottom-up view 12-A from FIG. 5A, of top piece 100 with notch 104 in rim 102, which mates with the notch in hollow channel first end 12 of FIG. 5A.

FIG. 4B illustrates a bottom-up view 12-A from FIG. 5A, of top piece 100 with notch 104 in rim 102, which mates with the notch in hollow channel first end 12 of FIG. 5A.

FIG. 5A illustrates an exploded view of the top half of the preferred assembly of the invention.

In FIG. 5A, a preferred embodiment of the invention includes a top piece 100 to be assembled with a lever mechanism including lever handle 62, protrusions 64 and 64-A, and coupling zone 66.

In FIG. 5A, the assembled top piece 100 with lever mechanism 62 is attached successively to hollow channel 10, and then to top cap 72. The attaching of hollow channel 10 locks the notch near first end 12 in FIG. 5A to notch 104 within rim 102 illustrated in FIGS. 4A to 5A.

In FIG. 5A, hollow helical shaft 20 is then inserted through the top cap 72 and hollow channel 10 to create the coupling of user control 62 with hollow helical shaft 20 illustrated in FIGS. 2A, 2B, 2C, 3A, and 3C.

Hollow helical shaft 20 is illustrated in FIGS. 2A to 3A, 3C, and 5A, including a coupling pin 22, which preferably provides part of the coupling between user control 62 and hollow helical shaft 20.

Hollow helical shaft 20 is illustrated in FIGS. 2A to 2C, and 5A, including a coupling pin 24, which preferably provides part of the coupling between user control 62, through hollow helical shaft 20 to switch 60.

In FIG. 5A, gear 34 is placed over the peg on top of housing 70.

In FIG. 5A, spring 26 is pressed onto coupling pin 24, upon which coupling gear 30 is inserted so that the notch in 30 locks onto coupling pin 24. The base of coupling gear 30 fits into the right hole of housing 70 as illustrated in FIGS. 2A to 2C.

Figure 5B:
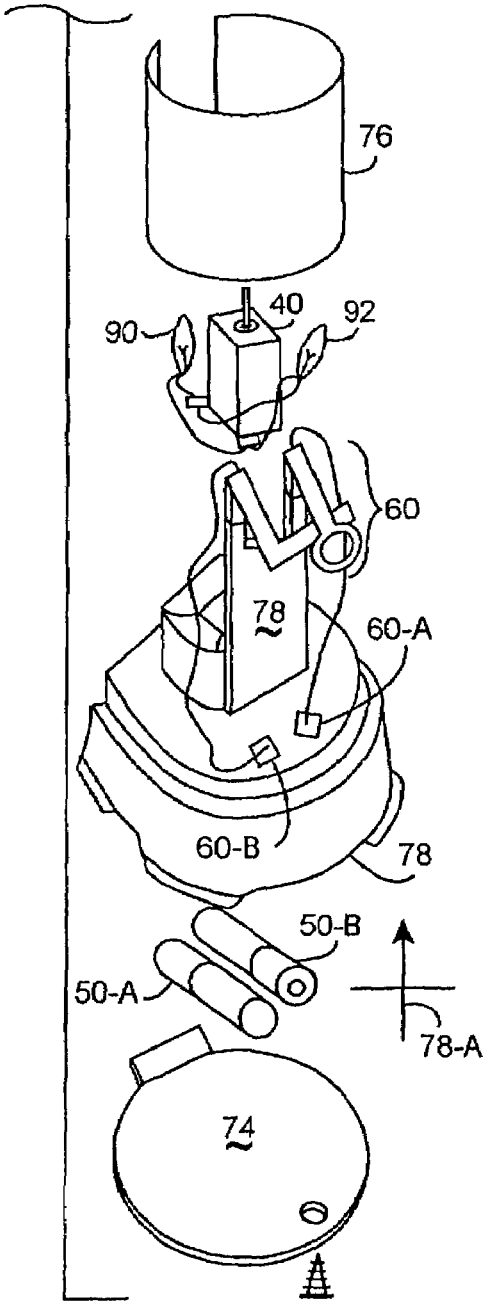
FIG. 5B illustrates an exploded view of the bottom half of the preferred assembly of the invention.

FIG. 5B illustrates an exploded view of the bottom half of the preferred assembly of the invention.

In FIG. 5B, electric motor 40 is inserted through the left hole in housing 70 of FIG. 5A into gear 32, which couples with gear 34, which further couples with coupling gear 30. The result of this assembly step is illustrated in FIGS. 2A to 2C.

In FIG. 5B, at least one, and preferably two light sources 90 and 92 are electrically coupled to motor terminals 42 and 44, also illustrated in FIGS. 2A, 2B, 2C, and 6C.

In FIG. 5B, switch 60 is attached to base 78.

In FIG. 5B, sheet 76 is inserted into housing 70, and then light sources 90-92 attached to electric motor 40 are inserted into base 78, which is fitted into housing 70 so that light sources 90-92, when active, shine through sheet 76, when seen from outside housing 70.

Figure 6A:
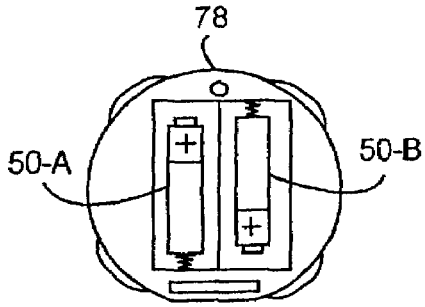
FIG. 6A illustrates a bottom-up perspective 78-A of FIG. 5B looking into the power supply 50 preferably including two batteries 50-A and 50-B.
Figure 6B:
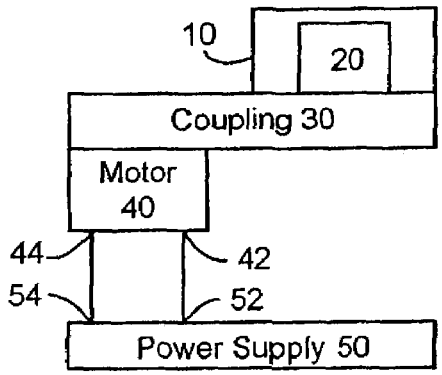
FIG. 6B illustrates a block diagram of the invention including hollow channel 10, hollow helical shaft 20, coupling 30, electric motor 40 and power supply 50.
Figure 6C:
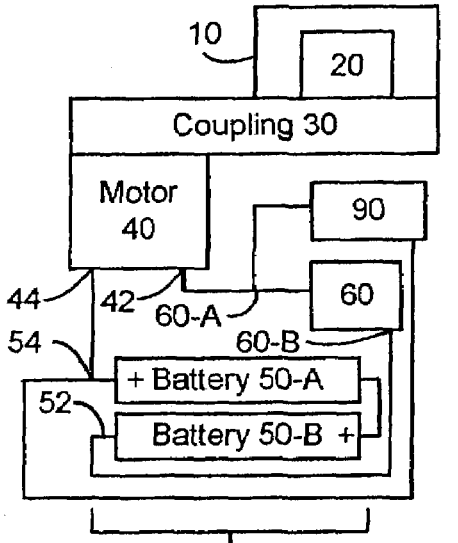
FIG. 6C illustrates a refinement of FIG. 6B further including switch 60 controlling electric motor 40, as well as, power supply 50 including two batteries 50-A and 50-B.

In FIG. 5B, batteries 50-A and 50-B are inserted into a power supply chamber in base 78 as illustrated in FIGS. 6A and 6C.

In FIG. 5B, bottom cap 74 is attached to base 78 using the slot illustrated in FIG. 6A and the screw illustrated in FIG. 5B.

Top piece 100 in FIG. 5A is shown slightly rotated so that attaching mechanism 82 is readily visible, which upon assembly, are preferably attached to top piece 100. The assembly of attaching mechanism 82 to top piece 100 may occur after assembling the elements of FIG. 5B.

Note that in certain preferred manufacturing processes the order of assembly may be approximately the reverse of that described for FIGS. 5A and 5B.

Note that in certain preferred embodiments, illustrated in FIGS. 1 to 2C, as well as FIG. 5A, housing 70 may be made of a clear molded plastic.

As illustrated in FIGS. 2A to 2C, as well as FIG. 5B, sheet 76 may be made of a tinted material similar in color to the fluid, when seen through the housing 70.

Using the invention preferably includes at least applying a strip to the logo zone 110 of FIG. 1.

As illustrated in FIGS. 2A to 2C, it is often preferred that the color of the hollow helical shaft 20 seen through channel 10 be similar to sheet 76 seen through housing 70.

As illustrated in FIGS. 1 to 2C, as well as 5A, top cap 72 may preferably include an exterior surface resembling a container top matching the exterior appearance of housing 70, foam, the fluid's surface, and/or ice cubes.

FIG. 6A illustrates a bottom-up perspective 78-A of FIG. 5B looking into the power supply 50 preferably including two batteries 50-A and 50-B.

FIG. 6B illustrates a block diagram of the invention including hollow channel 10, hollow helical shaft 20, coupling 30, electric motor 40 and power supply 50.

FIG. 6C illustrates a refinement of FIG. 6B further including switch 60 controlling electric motor 40, as well as, power supply 50 including two batteries 50-A and 50-B.

In FIGS. 6B and 6C, hollow helical shaft 20 rotates within hollow channel 10. Hollow helical shaft 20 couples 30 with electric motor 40.

In FIG. 6B, electric motor 40 terminals 42 and 44 respectively couple with two terminals 52 and 54 of power supply 50. Note that as used herein, power supply 50 may include any member of the collection comprising any form of batteries, preferably N-AAA batteries, any form of fuel cells, and/or any form of solar cells. Note that in larger embodiments, it may be further preferred that the power supply include a wind engine.

In FIG. 6C, electric motor terminal 44 also couples with terminal 54 of power supply 50. Power supply 50 preferably includes two batteries 50-A and 50-B, which are further preferred to be N-AAA batteries. Electric motor terminal 42 is preferably coupled to switch 60 first terminal 60-A and switch second terminal 60-B is coupled with power supply terminal 52.

One skilled in the art will recognize that there are alternative switches which may couple with both terminals of electric motor 40 and power supply 50, but will do so in an equivalent manner to that illustrated in these Figures. Such switches will at least operate in a similar manner to that illustrated in FIG. 6C. A switch 60 in the on-state will electrically couple the power supply 50 to electric motor 40 to enable hollow helical shaft 20 to rotate in hollow channel 10. A switch 60 in the on-state will electrically decouple the power supply 50 to electric motor 40 to prevent hollow helical shaft 20 from rotating in hollow channel 10.

Hollow helical shaft 20 as illustrated in FIGS. 1, 6B and 6C, does not require either coupling pin 22 nor coupling pin 24 to achieve the operational steps of the invention's method of providing a visual impression of fluid moving in a channel 10.

Switch 60 may be located outside housing 70 as indicated in FIG. 3B, where switch 60 is situated behind push button 62 in top piece 100.

The preceding embodiments have been provided by way of example and are not meant to constrain the scope of the following claims.

The invention claimed is:

1. An apparatus for creating a visual impression of a fluid flowing in an enclosed fluidless hollow channel possessing a first end and a second end, comprising:

a hollow helical shaft positioned between said first end and said second end within said hollow channel;

an electric motor to rotate said hollow helical shaft within said hollow channel; and an electrical power supply to power said electric motor in rotating said hollow helical shaft to create said visual impression, said electrical power supply further comprising a switch controlling said electric motor;

wherein said hollow helical shaft seen within said hollow channel has a color similar to said fluid;

a coupling of said hollow helical shaft between a user control located near said cylinder first end and said switch located near said cylinder second end;

wherein said user control operates in a member of the user control collection including at least a first control state and a second control state;

wherein whenever said user control operates in said first state, said hollow helical shaft coupling puts said switch into said off-state; and wherein whenever said user control operates in said second state, said hollow helical shaft coupling puts said switch into said on-state.

2. The apparatus of claim 1, wherein said user is selected from the group consisting of: a lever switch and a push-button.

3. The apparatus of claim 1, further comprising at least one light source providing lighting within said hollow channel whenever said hollow helical shaft is rotating to further create said visual impression; and wherein said light source is selected from the group consisting of: a light emitting diode, a fluorescent light source, and an incandescent light source.

4. The apparatus of claim 1, wherein said electric motor rotates at N_MOTOR Revolutions Per Minute (RPM) and engages a transmission; said transmission engages said hollow helical shaft rotating said hollow helical shaft at N_MOTOR/TRANSMISSION_RATIO to create said visual impression; and wherein said N_MOTOR/TRANSMISSION_RATIO is between 120 RPM and 240 RPM.

5. The apparatus of claim 4, wherein said transmission is selected from the group consisting of: a belt drive transmission, a gear driven transmission, a multi-belt drive transmission, a multi-gear driven transmission, and a combination belt-gear driven transmission.

6. The apparatus of claim 1, further comprising a top piece attached to said hollow channel near said first end.

7. The apparatus of claim 6, wherein said top piece includes a user control located near said cylinder first end.

8. The apparatus of claim 7, wherein said user control is a switch controlling said electric motor rotating said hollow helical shaft to create said visual impression.

9. The apparatus of claim 7, wherein said hollow helical shaft is further coupled with both said user control located near said cylinder first end and with a switch located near said cylinder second end;

wherein said switch operates in a member of a switch operational collection comprising at least an on-state and an off-state;

wherein whenever said switch operates in said on-state, said switch enables said electric motor to rotate said hollow helical shaft to create said visual impression;

wherein whenever said user control operates in said first state, said hollow helical shaft coupling puts said switch into said off-state;

wherein whenever said user control operates in said second state, said hollow helical shaft coupling puts said switch into said on-state; and wherein whenever said switch operates in said off-state, said switch prevents said electric motor from rotating said hollow helical shaft.

10. The apparatus of claim 6, wherein top piece further comprises a second attaching mechanism enabling said top piece to be attached to a display mount; wherein said second attaching mechanism is selected form the group consisting of: an essentially flat surface, a magnet, and a suction cup.

11. An apparatus for creating a visual impression of a beverage flowing in an enclosed fluidless hollow channel possessing a first end and a second end, comprising:

a hollow helical shaft positioned between said first end and said second end within said hollow channel;

an electric motor to rotate said hollow helical shaft within said hollow channel in a manner which creates a visual impression of selected beverage flowing; and an electrical power supply to power said electric motor in rotating said hollow helical shaft to create said visual impression;

wherein said hollow helical shaft seen within said hollow channel has a color similar to said selected beverage;

a housing containing said electrical motor coupled with said power supply; said housing further supporting said hollow helical shaft positioned between said first end and said second end within said hollow channel; and wherein said housing includes an exterior shape which provides an exterior shape visual impression selected from the group consisting of: a can, a bottle, a glass, and a mug; said housing further contains said electrical power supply electrically coupled with said electric motor and with a switch to control said electric motor in rotating said hollow helical shaft to create said visual impression wherein said switch includes an on-state and an off-state;

wherein whenever said switch operates in said on-state, said switch electrically couples said electrical power supply with said electric motor rotating said hollow helical shaft to create said visual impression;

wherein whenever said switch operates in said off-state, said switch electrically decouples said electrical power supply from said electric motor to prevent said electric motor from rotating said hollow helical shaft to create said visual impression;

said hollow helical shaft coupling with both a user control located near said cylinder first end and with a switch located near said cylinder second end;

wherein said user control includes a first control state and a second control state;

wherein whenever said user control operates in said first control state, said hollow helical shaft coupling puts said switch into said off-state; and wherein whenever said user control operates in said second control state, said hollow helical shaft coupling puts said switch into said on-state.

12. The apparatus of claim 11, wherein said housing further comprises an external surface providing a logo zone.

13. The apparatus of claim 12, wherein said external surface further includes at least one attaching mechanism enabling said external surface to be attached to a display mount.

14. The apparatus of claim 13, wherein said display mount is a member of the collection comprising a cap, a hat, a shirt, a wall, a refrigerator, an automotive surface, a cash register, and a computer terminal.

15. The apparatus of claim 11, wherein said electric motor rotates at N_MOTOR Revolutions Per Minute (RPM) and couples with a transmission; said transmission couples with said hollow helical shaft to power rotating said hollow helical shaft rotating at N_MOTOR/TRANSMISSION_RATIO to create said visual impression; and wherein said N_MOTOR/TRANSMISSION_RATIO is between 120 RPM and 240 RPM.

16. The apparatus of claim 15, wherein said transmission selected from the group consisting of: a belt drive transmission, a gear driven transmission, a multi-belt drive transmission, a multi-gear driven transmission, and a combination belt-gear driven transmission.

17. The apparatus of claim 11, wherein said housing is selected from the group consisting of:

a top cap supporting said hollow channel near said second end to provide a fourth visual impression of an upper surface of said fluid in said housing; and a bottom cap near said electrical power supply enabling replacement of said electrical power supply.

18. The apparatus of claim 11, wherein said hollow channel is selected from the group consisting of: a circular hollow cylinder, a rectangular hollow channel, an elliptical hollow channel, and an exterior of said hollow channel differing in shape from an interior of said hollow channel.

19. A method of attaching the apparatus of claim 11 to a display mount, said apparatus provides a visual impression of a fluid flowing through a channel into a housing, and includes an attaching mechanism, said method comprising the steps:

providing a mounting surface of said display mount; and non-invasively attaching said apparatus to said mounting surface using said attaching mechanism.

20. The method of claim 19, wherein said step providing said mounting surface of said display mount further comprises at least step of the group consisting of:

providing an essentially vertical surface of a beret as said mounting surface;

providing an essentially vertical surface of a cap as said mounting surface;

providing an essentially vertical surface of a hat as said mounting surface;

providing a exterior surface of a shirt as said mounting surface;

providing a portion of a wall as said mounting surface;

providing a visible surface of a refrigerator as said mounting surface;

providing an automotive surface as said mounting surface;

providing a cash register surface as said mounting surface; and providing a portion of a computer terminal as said mounting surface.

21. The method of claim 19, wherein said attaching mechanism includes at least one member of the group consisting of: an essentially flat surface, a magnet, a hook and loop fastener, and a suction cup.

22. The product of the process of claim 19.

23. An apparatus for creating a visual impression of a fluid flowing in an enclosed fluidless hollow channel possessing a first end and a second end, comprising:

a hollow helical shaft positioned between said first end and said second end within said hollow channel;

an electric motor to rotate said hollow helical shaft within said hollow channel; and an electrical power supply to power said electric motor in rotating said hollow helical shaft to create said visual impression;

wherein said hollow helical shaft seen within said hollow channel has a color similar to said fluid;

a housing containing said electrical motor coupled with said power supply; said housing further supporting said hollow helical shaft positioned between said first end and said second end within said hollow channel; and wherein said housing includes an exterior shape which provides an exterior shape visual impression is selected from the group consisting of: a can, a bottle, a glass, a mug, a cup, and a tub, wherein said housing further contains at least one light source providing lighting within said hollow channel whenever said hollow helical shaft is rotating.

24. The apparatus of claim 23, wherein said light source further provides lighting within said housing seen from an outside view of said housing to create at least one visual impression selected from the group consisting of:

a second visual impression of said fluid in said housing; and a third visual impression of said fluid flowing into said housing.

25. The apparatus of claim 24, wherein said housing further comprises a visual layer between at least one of said light sources and said outside view to contribute to creating at least one of said second and third visual impressions.

* * * * *